United States Patent [19]

Hake et al.

[11] Patent Number: 5,065,984

[45] Date of Patent: Nov. 19, 1991

[54] CLAMP ASSEMBLY FOR REMOVING PINS FROM A CONCRETE FORM

[75] Inventors: Leon M. Hake; Ronald D. Zerr, both of Perry, Okla.

[73] Assignee: EZ Drill, Inc., Stillwater, Okla.

[21] Appl. No.: 596,170

[22] Filed: Oct. 10, 1990

[51] Int. Cl.[5] ..... B25C 11/00

[52] U.S. Cl. ..... 254/18

[58] Field of Search ..... 294/118; 254/30, 18, 254/22–23

[56] References Cited

U.S. PATENT DOCUMENTS

| | | | |
|---|---|---|---|
| 1,014,068 | 1/1912 | Kostenbader | 254/18 |
| 1,870,133 | 8/1983 | Myers | 294/118 |
| 3,201,167 | 8/1965 | Wampler | 294/118 |
| 3,208,789 | 9/1965 | Barry | 294/118 |
| 3,336,001 | 8/1967 | Barton | 254/18 |
| 3,837,699 | 9/1974 | Anderson et al. | 294/118 |
| 4,078,766 | 3/1978 | Saurwein | 254/18 |
| 4,530,536 | 7/1985 | Williams | 294/118 |
| 4,904,009 | 2/1990 | Kozlinski | 284/118 |

*Primary Examiner*—Robert C. Watson

*Attorney, Agent, or Firm*—Dunlap, Codding, Peterson & Lee

[57] ABSTRACT

An apparatus for pullingly removing pins from a concrete form using a lifting mechanism. The apparatus comprises a clamp assembly having a first and a second jaw connected thereto. The clamp assembly is movable to an opened position wherein the first and the second jaws are spaced a distance apart and the clamp assembly is movable to a closed position wherein the jaws are positioned in clamping engagement with the pin. The clamp assembly is moved to the opened position and the jaws are positioned generally about the pin to be removed. The clamp assembly is connected to the lifting mechnism. The lifting mechanism is moved in an upwardly direction thereby causing the clamp assembly to be moved to the closed position for moving the first and the second jaws into clamping engagement with the pin. The lifting mechanism then is further moved in the upwardly direction for pullingly removing the pin.

2 Claims, 2 Drawing Sheets

CLAMP ASSEMBLY FOR REMOVING PINS FROM A CONCRETE FORM

FIELD OF THE INVENTION

The present invention generally relates to devices for pullingly removing pins from concrete forms and, more particularly, to a clamp assembly which is connected to a lifting mechanism wherein the clamp assembly is movable from an opened to a closed position and wherein the clamp assembly clampingly engages the pin to be removed as the lifting mechanism pulls the clamp assembly in the upwardly direction.

DESCRIPTION OF THE PREFERRED EMBODIMENTS

Figure 2:
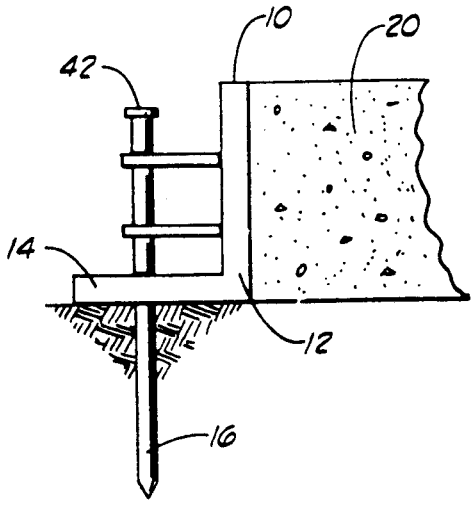
FIG. 2 is a side elevational view of a typical concrete form showing one pin positioned in the concrete form for securing the concrete form in a stationary position.

Shown in FIG. 2 is an end elevational view of a concrete form 10. The concrete form includes an upwardly extending portion 12 and a flange 14 connected to the lower end of the upwardly extending portion 12 and extending generally perpendicular therefrom. A plurality of pins 16 (only one pin 16 being shown in FIGS. 2, 3, 4 and 5) are driven through holes (not shown) in the concrete form 10 and into the underneath structure for holding the concrete form 10 in a stationary position with the upwardly extending portion 12 extending generally upwardly from a underneath structure or ground surface. After the concrete form has been secured in the position shown in FIG. 2, concrete 20 then is poured into the space between two concrete forms I0 (only one of the concrete forms 10 being shown in FIG. 2). After the concrete 20 has set, it is necessary to remove the concrete forms 10. In the removal process, it first is necessary to remove all of the pins 16.

The use of concrete forms like the concrete form 10 and the use of pins like the pin 16 for holding the concrete form in a stationary position are well known in the art and a detailed description of such concrete forms, the pins or the process for installing the concrete forms with the pins and subsequently removing the pins so that the concrete forms may be removed are all well known in the art and a detailed description of such is not deemed necessary herein.

Figure 1:
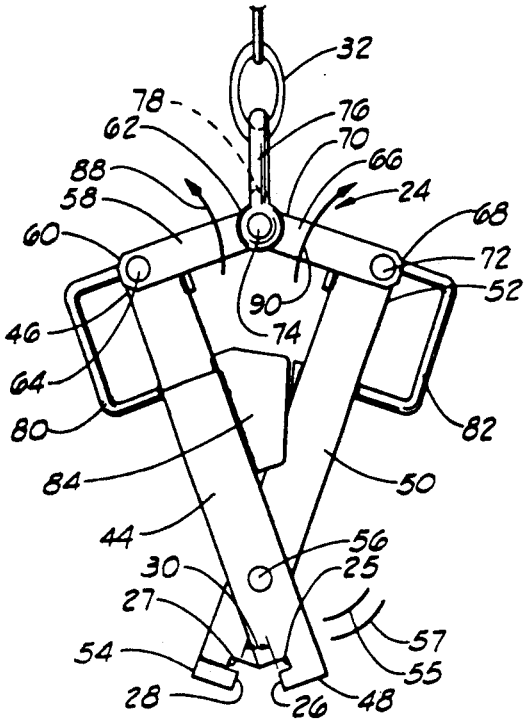
FIG. 1 is a side elevational view of a clamp assembly constructed in accordance with the present invention.

The present invention relates to an apparatus 22 (FIGS. 2, 3, 4 and 5) for pullingly removing the pins 16 from the concrete form 10 The apparatus 22 basically consists of a clamp assembly 24, as shown more clearly in FIG. 1. The first jaw 26 more particularly comprises a notch 25 (FIG. 1). The second jaw 29 more particularly comprises a notch 27 (FIG. 1). The clamp assembly 24 includes a first jaw 26 and a second jaw 28. The first and the second jaws 26 and 28 each are connected to the clamp assembly 24.

The clamp assembly 24 is movable to an opened position (shown in FIGS. 1 and 3) wherein the first and the second jaws 26 and 28 are spaced a distance 30 (FIG. 1) apart. The clamp assembly 24 also is movable toward a closed position (shown in FIGS. 4 and 5) wherein the first jaw 26 is moved generally toward the second jaw 28 thereby decreasing a distance 30.

One end of a chain 32 is pivotally connected to the clamp assembly 24. The opposite end of the chain 32 is pivotally connected to a lift portion 34 (FIGS. 3, 4 and 5) of a lifting mechanism 36 (FIGS. 3, 4 and 5).

Figure 3:
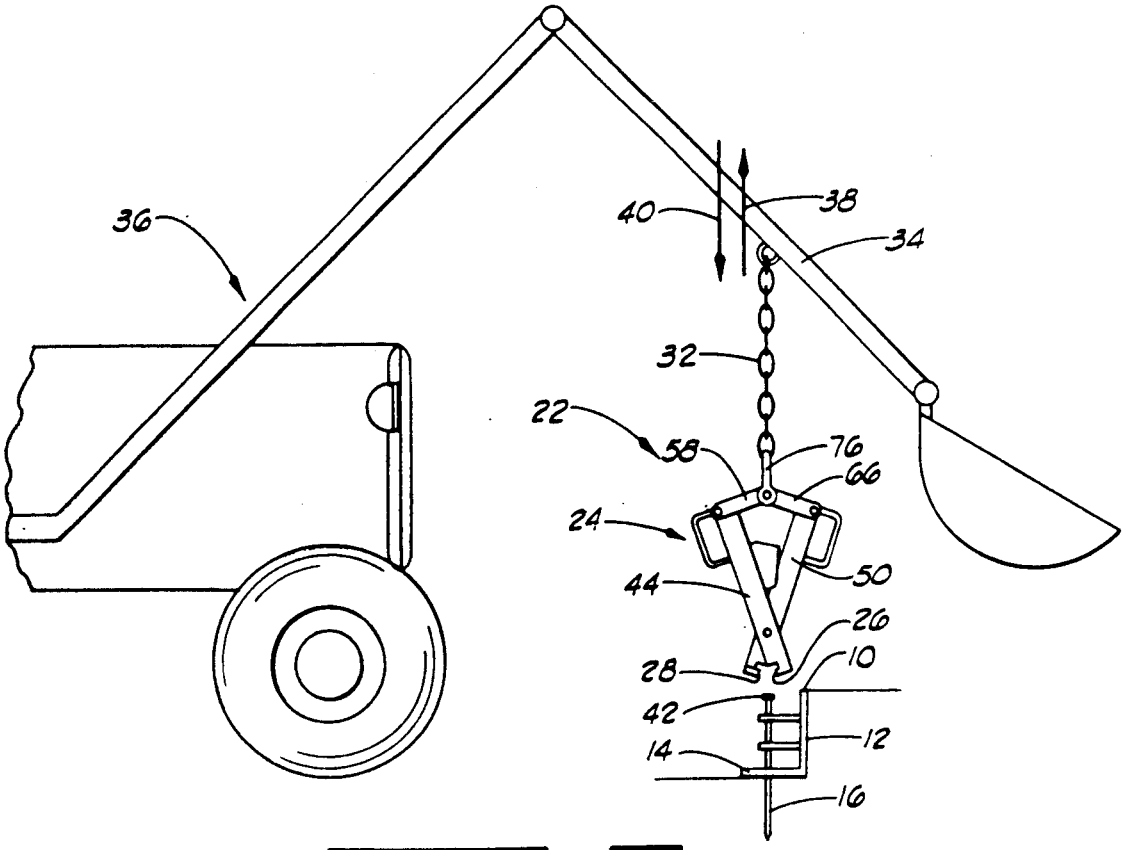
FIG. 3 is a side elevational view of a clamp assembly and showing the clamp assembly in the opened position. The clamp assembly is positioned generally above a pin in a concrete form. The clamp assembly in FIG. 3 is shown connected to a lifting mechanism.
Figure 4:
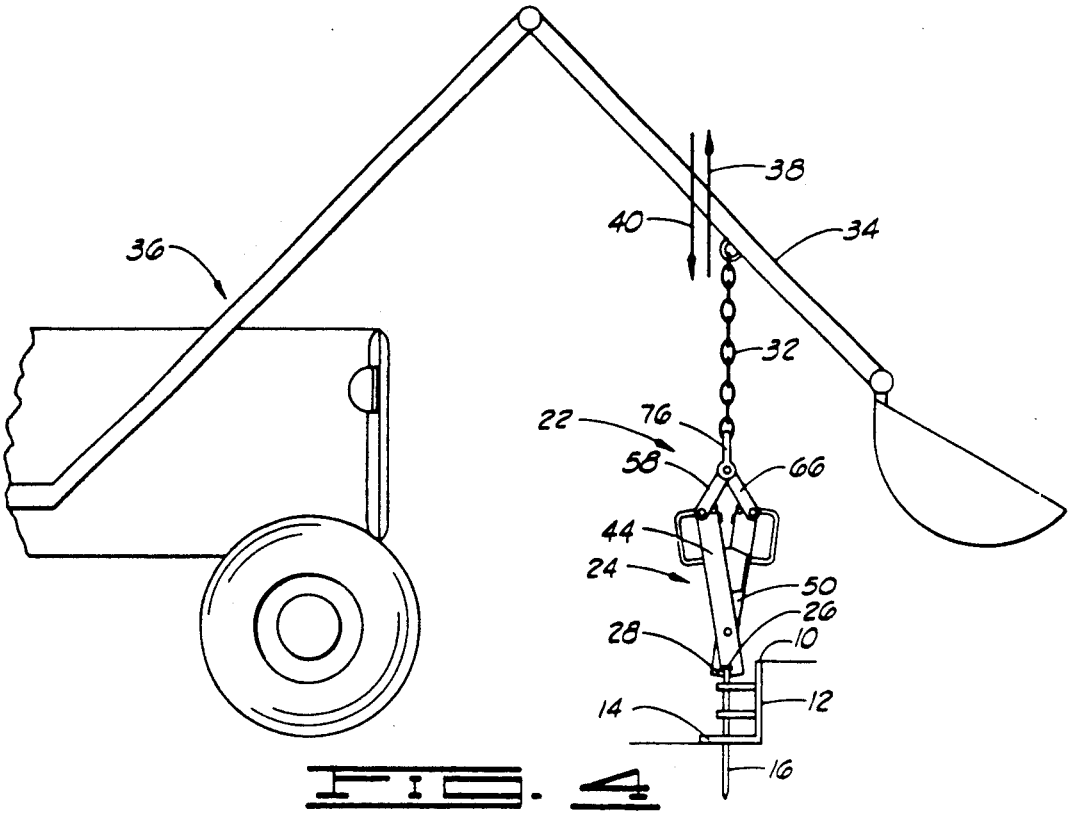
FIG. 4 is a view similar to FIG. 3, but showing the clamp assembly clampingly engaged with the pin to be removed.
Figure 5:
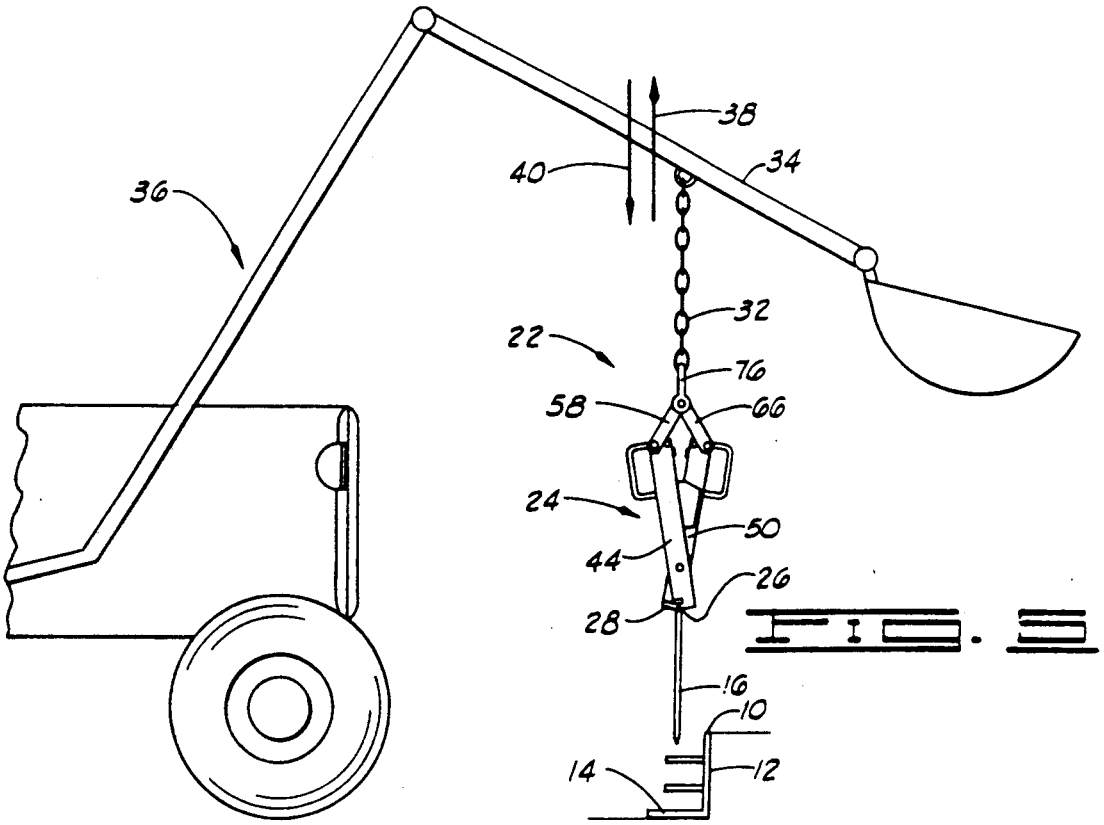
FIG. 5 a view similar to FIGS. 3 and 4, but showing the clamp assembly clampingly connected to the pin and showing the pin in a removed position.

The lifting mechanism 36 may be any type of equipment adapted to move the lift portion 34 in a generally upwardly direction 38 (FIGS. 3, 4 and 5) and a generally downwardly direction 40 (FIGS. 3, 4 and 5). For example, the lifting mechanism 36 may be a front end loader wherein the lift portion 34 is an arm having a bucket and the arm and the bucket is movably connected to the lifting mechanism 36 or the front end loader. The front end loader is adapted to move the arm and the bucket or lift portion 34 in the generally upwardly direction 38 and in the generally downwardly direction 40. It should be noted that, in one preferred form, the chain 32 is connected to the bucket rather than the arm. Front end loaders are well known in the art and a detailed description of a front end loader is not deemed necessary herein.

In operation, the clamp assembly 24 is positioned generally above the pin 16 to be removed (FIG. 3). The clamp assembly 24 then is moved to the opened position wherein the first and the second jaws 26 and 28 are spaced the distance 30 apart (FIG. 3). The distance 30 is greater than the diameter of a pin head 42 (FIG. 2) formed on the upper end of the pin 16. In this position, the clamp assembly 24 is moved in the downward direction 40 to a position wherein the first and the second jaws 26 and 28 are positioned generally on opposite sides of the pin 16 and generally below the pin head 42.

After the first and the second jaws 26 and 28 have been positioned about the pin 16 to be removed, the lifting mechanism 36 is activated to move the lift portion 34 in the generally upwardly direction 38. As the lift portion 38 is moved in the upwardly direction 38, the lift portion 34 pulls on the clamp assembly 24 via the chain 30 pulling the clamp assembly 24 in the upwardly direction 38 and causing the clamp assembly 24 to be moved toward the closed position (FIG. 4). As the clamp assembly 24 is moved toward the closed position, the first jaw 26 is moved toward the second jaw 28 and the first and the second jaws 26 and 28 are moved into clamping engagement with the pin 16 to be removed. More particularly, the pin head 42 is disposed in the notches 25 and 27 and the first and second jaws 26 and 28 clampingly engage the pin 16.

As the lift portion 34 continues to be moved in the upwardly direction 38, the lift portion 34 pulls the clamp assembly 24 further in the upwardly direction 38 via the chain 32 thereby pulling the pin 16 in the upwardly direction 38 for removing the pin 16 from the concrete form 10 (FIG. 5). In addition, as the lift portion 34 moves in the upwardly direction, the clamp assembly 24 continually is biased toward the closed position for maintaining the first and the second jaws 26 and 28 in clamping engagement with the pin 16 to be removed as the lift portion 34 and the pin 16 to be removed are moved in the upwardly direction 38.

As shown more clearly in FIG. 1, the clamp assembly 24 comprises a first clamp arm 44 having a first end 46 and a second end 48. The clamp assembly 24 also comprises a second clamp arm 50 having a first end 52 and a second end 54.

The first clamp arm 44 at a position generally between the first end 46 and the second end 48 thereof is pivotally connected to the second clamp arm 50 at a position generally between the first end 52 and the second end 54 thereof by way of a pivot end 56. The first and the second clamp arms 44 and 50 thus are pivotally connected whereby the first clamp arm is pivotally movable in one direction 55 about the second clamp arm 50 and pivotally movable in a generally opposite direction 57 generally about the second clamp arm 50. The second clamp arm 50 also is pivotally movable in the directions 55 and 57 generally about the first clamp arm 44.

The first jaw 26 is connected to the second end of the first clamp arm 44. The second jaw 28 is connected to the second end 54 of the second clamp arm 50. In one form, as shown in FIG. 1, the first and second jaws 26 and 28, more particularly, are formed on the respective first and second clamp arms 44 and 50.

As shown more clearly in FIG. 1, the clamp assembly 24 also includes a first lift arm 58. The first lift arm 58 has a first end 60 and a second end 62. The first end 60 of the first lift arm 58 is pivotally connected to the first end 46 of the first clamp arm 44 by way of a pivot pin 64.

The clamp assembly 24 also includes a second lift arm 66. The second lift arm 66 has a first end 68 and a second end 70. The first end 68 of the second lift arm 66 is pivotally connected to the first end 52 of the second clamp arm 50 by way of a pivot pin 72 (FIG. 1).

The second end 62 of the first lift arm 58 is pivotally connected to the second end 70 of the second lift arm 66 by way of a pivot pin 74 (FIG. 1).

An eye flange 76 is pivotally connected to the second end 62 of the first lift arm 58 and pivotally connected to the second end 70 of the second lift arm 66. The pivot pin 74 more particularly also connects the eye flange 76 to the second ends 62 and 70 of the first and the second lift arms 58 and 66. The eye flange 76 has an eye opening 78 (FIG. 1) formed therethrough. One end of the chain 32 more particularly is removably and pivotally connected to the eye flange 76 through the eye opening 78.

The clamp assembly 24 includes a first handle 80 and a secondhandle 82. The first and second handles 80 and 82 each are adapted to be gripped for manually moving the clamp assembly 24 to the opened position and the closed position.

The clamp assembly 24 also includes a safety flange 84 and a second safety flange (not shown) for covering the pinch point between the first and second clamp arms 44 and 50.

When the chain 32 is moved in the upward direction 38 via the lift mechanism 36, the first lift arm 58 is pivotally moved in a direction 88 and the second lift arm 66 is moved in a direction 90 (FIG. 1). The movement of the first lift arm 58 in the direction 88 causes the first clamp arm 44 to be pivotally moved in the direction 55 toward clamping engagement with the pin 16. The movement of the second lift arm 66 in the direction 90 causes the second clamp arm 50 to be pivotally moved in the direction 57 toward the closed position and into clamping engagement with the pin 16.

Changes may be made in the construction and the operation of the various parts, elements and assemblies described herein and changes may be made in the steps or the sequence of steps of the methods described herein without departing from the spirit and scope of the invention as defined in the following claims.

What is claimed is:

1. An improvement in an apparatus for pullingly removing pins having a pin head on one end thereof from a concrete form using an existing lifting mechanism having a lift portion movable in an upwardly direction and in a downwardly direction, the improvement comprising:

a clamp assembly a having a first jaw and a second jaw connected thereto, the clamp assembly being movable to an opened position wherein the first and the second jaws are spaced a distance apart, and the clamp assembly being movable to a closed position wherein the first and the second jaws are positioned in clamping engagement with the pin to be removed , the clamp assembly comprising:

a first clamp arm having a first end and a second end, the first jaw being connected to the second end of the first clamp arm;

a second clamp arm having a first end and a second end, the second jaw being connected to the second end of the second clamp arm;

means for pivotally connecting the first clamp arm at a position between the first and the second ends of the first clamp arm to the second clamp arm at a position between the first and the second ends of second clamp arm, the a means for connecting the clamp assembly to the lift position being connected to the first ends of the first and second clamp arms;

a first lift arm having a first end and a second end, the first end of the first lift arm being pivotally connected to the first end of the first clamp arm;

a second lift arm having a first end and a second end the first end of the second lift arm being pivotally connected to the first end of the second clamp arm, and the second end of the second lift arm being pivotally connected to the second end of the first lift arm, the means for connecting the clamp assembly to the lift portion being connected to the second ends of the first and the second lift arms;

an eye flange having an eye opening formed therethrough the means for connecting the clamp assembly to the lift portion of the lifting mechanism being connected to the eye flange;

a first handle; and a second handle, the first and the second handles each being adapted to be gripped for manually moving the clamp assembly to the opened position and the closed position;

means for connecting the clamp assembly to the lift portion of the lifting mechanism, the clamping assembly being moved to the opened position a and positioned over the pin to be removed, and the lift portion being movable a distance in the upwardly direction for moving the clamp assembly a distance int e upwardly direction and causing the clamp assembly to be moved toward the closed position wherein the first and the second jaws clampingly engage the pin to be removed, and the lift portion being movable a further distance into upwardly direction for pulling the clamp assembly the pin connected thereto via the first and second jaws in the upwardly direction for pullingly removing heaping the pulling of the clamp assembly int e upwardly direction continues to move the clamp assembly toward the closed position for maintaining the clamping engagement between the clamp assembly and the pin as the lift portion continues to move in the upwardly direction.

2. An apparatus for pulling removing pins having a pin head on one end thereof form a concrete form using one existing lifting mechanism having a lift portion movable in an upwardly direction and an a downwardly direction comprising:

a clamp assembly having a first jaw and a second jaw connected thereto the clamp assembly being movable to an opened position wherein the first and the second jaws are spaced a distance apart, and the clamp assembly being movable to a closed position wherein the first and the second jaws are positioned in clamping engagement with the pin to be removed, the clamp assembly comprising:

a first clamp arm having a first end and a second end, the first jaw being connected to the second end of the first clamp arm;

a second clamp arm having a first end and a second end, the second jaw being connected to the second end of the second clamp arm;

means for pivotally connecting the first clamp arm at a position between the first and the second ends of the first clamp arm to the second clamp arm at a position between the first and the second ends of second clamp arm, the means for connecting the clamp assembly to the lift portion being connected to the first end of the first and second clamp arms;

a first lift arm having a first end and a second end, the first end of the first lift arm being pivotally connected to the first end of the first clamp arm;

a second lift arm having a first end and a second end, the first end of the second lift arm being pivotally connected to the first end of the second clamp arm, and the second end of the second lift arm being pivotally connected to the second end of the first lift arm, the means for connecting the clamp assembly to the lift portion being connected to the second ends of the first and the second lift arms;

an eye flange having an eye opening formed therethrough, the means for connecting the clamp assembly tot eh lift portion the lifting mechanism being connected to the eye flange;

a first handle; and a second handle, the first and the second handles each being adapted to be gripped for manually moving the clamp assembly to the opened position and the closed position;

means for connecting the clamp assembly to the lift position of the lifting mechanism, thumping assembly being moved to the opened positioned positioned over the pin to be removed, and the lift portion being movable a distance in the upwardly direction for moving the clamp assembly a distance int upwardly direction and causing the clamp assembly to be moved toward the closed position wherein the first and the second jaws clampingly engage the pin to be removed, and the lift portion being movable a further distance in the upwardly direction for pulling the clamp assembly and the pin connected thereto via the first and second jaws in the upwardly direction for pullingly removing the pin , the pulling of the clamp assembly in the upwardly direction continues to move the clamp assembly toward the closed position for maintaining the clamping engagement between the clamp assembly and the pin as the lift portion continues to move in the upwardly direction.

* * * * *

UNITED STATES PATENT AND TRADEMARK OFFICE
CERTIFICATE OF CORRECTION

PATENT NO. : 5,065,984

DATED : November 19, 1991

INVENTOR(S) : Leon M. Hake

It is certified that error appears in the above-identified patent and that said Letters Patent is hereby corrected as shown below:

Column 4, line 42, a comma --,-- should be added after the first word, end.

Column 4, line 51, a comma --,-- should be added after the word, through.

Column 4, line 61, delete the word "a".

Column 4, line 65, the words "int e" should be --in the--.

Column 5, line 1, the word "into" should be --in the--.

Column 5, line 2, insert the word --and-- after the word, assembly.

Column 5, line 6, the word "heaping" should be changed to --the pin,--.

Column 5, line 6, the words "int e" should be --in the--.

Column 5, line 14, the phrase "form a concrete form" should be --from a concrete form--.

Column 5, line 16, the word "an' (2nd occurrence) should be --in--.

UNITED STATES PATENT AND TRADEMARK OFFICE
CERTIFICATE OF CORRECTION

PATENT NO. : 5,065,984

DATED : November 19, 1991

INVENTOR(S) : Leon M. Hake

It is certified that error appears in the above-identified patent and that said Letters Patent is hereby corrected as shown below:

Column 5, line 19, a comma --,-- should be added after the word, thereto.

Column 6, line 15, the words "tot eh" should be --to the--.

Column 6, line 23, the word "position" should be --portion--.

Column 6, line 23, the word "thumping" should be --the clamping--.

Column 6, line 24, the word "positioned" should be --position and--.

Column 6, line 28, the word "int" should be --in the--.

Signed and Sealed this

Eighth Day of June, 1993

*Attest:*

*Attesting Officer*

Michael K. Kirk

MICHAEL K. KIRK

*Acting Commissioner of Patents and Trademarks*